US010500870B2

(12) United States Patent
Buxton et al.

(10) Patent No.: US 10,500,870 B2
(45) Date of Patent: Dec. 10, 2019

(54) PRINTING APPARATUS AND METHOD

(71) Applicant: Videojet Technologies Inc., Wood Dale, IL (US)

(72) Inventors: Keith Buxton, Mapperley Planes (GB); Gary Pfeffer, Woodthorpe (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 15/759,916

(22) PCT Filed: Sep. 14, 2016

(86) PCT No.: PCT/GB2016/052843
§ 371 (c)(1),
(2) Date: Mar. 14, 2018

(87) PCT Pub. No.: WO2017/046585
PCT Pub. Date: Mar. 23, 2017

(65) Prior Publication Data

US 2019/0047296 A1 Feb. 14, 2019

(30) Foreign Application Priority Data

Sep. 14, 2015 (GB) ..... 1516248.0

(51) Int. Cl.

| | |
|---|---|
| ***B41J 2/30*** | (2006.01) |
| ***B41J 2/325*** | (2006.01) |
| ***B41J 25/304*** | (2006.01) |
| ***B41J 25/312*** | (2006.01) |
| ***B41J 25/316*** | (2006.01) |
| ***B41J 2/305*** | (2006.01) |
| ***B41J 2/35*** | (2006.01) |

(52) U.S. Cl.
CPC ..... *B41J 2/305* (2013.01); *B41J 2/325* (2013.01); *B41J 2/35* (2013.01); *B41J 25/304* (2013.01); *B41J 25/312* (2013.01); *B41J 25/316* (2013.01)

(58) Field of Classification Search
CPC ... B41J 2/305; B41J 2/325; B41J 2/304; B41J 2/35; B41J 25/304; B41J 25/312; B41J 25/316
See application file for complete search history.

(56) References Cited

FOREIGN PATENT DOCUMENTS

| | | |
|---|---|---|
| GB | 2519371 A | 4/2015 |
| WO | 200222371 A2 | 3/2002 |
| WO | 2013025746 A1 | 2/2013 |

*Primary Examiner* — Jason S Uhlenhake
(74) *Attorney, Agent, or Firm* — Beusse, Wolter, Sanks & Maire PLLC; Robert L. Wolter

(57) ABSTRACT

A printer comprising a printhead configured to selectively cause a mark to be created on a substrate, a first motor coupled to the printhead and arranged to vary the position of the printhead relative to a printing surface against which printing is carried out to thereby control the pressure exerted by the printhead on the printing surface, and a controller arranged to control the first motor. The controller is arranged to control the magnitude of current supplied to windings of the first motor so as to cause a predetermined pressure to be exerted by the printhead on the printing surface.

20 Claims, 7 Drawing Sheets

PRINTING APPARATUS AND METHOD

The present invention relates to a printer. More particularly, but not exclusively, the invention relates to methods for controlling the pressure exerted by a printhead on a printing surface against which printing is to take place, and printers which embody such methods.

Thermal transfer printers use an ink carrying ribbon. In a printing operation, ink carried on the ribbon is transferred to a substrate which is to be printed. To effect the transfer of ink, a print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

In some thermal transfer printers, printing is effected by use of a stationary printhead, past which ribbon and substrate are moved. This operation may be referred to as "continuous" printing. Here the print speed is defined by the speed of movement of the substrate and ribbon past the stationary printhead. However, in an alternative printing technique (so-called "intermittent" printing), the substrate and ribbon are held stationary and the printhead is moved relative to the stationary substrate and ribbon. Here the print speed is defined by the speed of movement of the printhead relative to the stationary ribbon and substrate.

Direct thermal printers also use a thermal printhead to generate marks on a thermally sensitive substrate. A print head is brought into direct contact with the substrate. When printing elements of the print head are heated, whilst in contact with the substrate, marks are formed on the regions of the substrate which are adjacent to printing elements which are heated.

It is known that various factors affect print quality. For example it is important that the printhead is properly positioned relative to the printing surface and also important that the printhead applies an appropriate pressure to the printing surface and the ribbon and substrate which is sandwiched between the printhead and the printing surface.

Movement of the printhead relative to the printing surface (i.e. towards and away from the printing surface) is, in some prior art printers, effected pneumatically by an air cylinder which presses the printhead into contact with the printing surface and any substrate and ribbon located between the printhead and the printing surface. Such an arrangement is effective but has associated disadvantages. In particular, it is usually not readily possible to vary the pressure applied by the printhead, and use of the printer requires an available supply of compressed air.

It is an object of some embodiments of the present invention to provide a novel printer which obviates or mitigates at least some of the disadvantages set out above.

According to a first aspect of the invention there is provided a printer comprising: a printhead configured to selectively cause a mark to be created on a substrate; a first motor coupled to the printhead and arranged to vary the position of the printhead relative to a printing surface against which printing is carried out to thereby control the pressure exerted by the printhead on the printing surface; and a controller arranged to control the first motor. The controller is arranged to control the magnitude of current supplied to windings of the first motor so as to cause a predetermined pressure to be exerted by the printhead on the printing surface.

Control of the magnitude of current supplied to windings of the first motor allows the first motor to be controlled in a torque controlled manner so as to generate a predetermined output torque. Such a generated torque can be converted (via a suitable mechanical coupling) to a predetermined force (corresponding for a particular area to a predetermined pressure) which is to be exerted by the printhead on the printing surface during printing operations. That is, by torque-controlling the first motor, accurate control of the printing pressure can be realised.

The controller may be arranged to control the first motor in first and second operating modes. In the first operating mode, the controller may be arranged to control the magnitude of current supplied to windings of the first motor so as to cause a predetermined pressure to be exerted by the printhead on the printing surface. In the second operating mode, the controller may be arranged to control the angular position of an output shaft of the first motor so as to control the position of the printhead relative to the printing surface.

The first operating mode may be referred to as a torque-controlled mode. That is, in the first operating mode, torque may be the dominant control parameter. The torque generated by the first motor may have a known relationship with the current supplied to the windings of the first motor. The pressure exerted by the printhead on the printing surface may have a known relationship with the torque generated by the first motor. Thus, by controlling the magnitude of current supplied to windings of the first motor it is possible to control the pressure exerted by the printhead on the printing surface.

The second operating mode may be referred to as a position-controlled mode. That is, in the second operating mode, position may be the dominant control parameter. More particularly, the angular position of the output shaft of the first motor may be a controlled parameter. It will be appreciated that in a position-controlled mode, torque generated by the motor may still be controlled. For example, in a position-controlled mode the torque generated by the motor may be controlled so as to cause the output shaft of the motor to move to desired angular position.

By controlling a motor in first and second operating modes, it is possible to achieve improved printer performance by ensuring that a control mode is appropriate for the particular situation. For example, by operating the first motor in a torque controlled mode, it is possible accurately control the pressure exerted by the printhead on the printing surface. On the other hand, by controlling the first motor in a position-controlled mode, it is possible to quickly and efficiently position the printhead relative to the printing surface.

In the second operating mode the printhead may be spaced apart from the printing surface.

Operating the first motor in a position controlled mode when the printhead is spaced apart from the printing surface allows the printer to be operated quickly and efficiently, and allows the printhead to be withdrawn from the printing surface by a predetermined amount between the printing of consecutive images. Whereas, if torque-only control is used, where there is no mechanical resistance to rotation of the output shaft of the first motor (e.g. when the printhead is spaced apart from the printing surface) the printhead may not be able to be maintained stably in an arbitrary positon (i.e. a free space position).

Controlling the magnitude of current supplied to the windings of the first motor may comprise controlling the magnitude of the current so as to not exceed a predetermined maximum value.

The predetermined maximum value may correspond to a predetermined maximum torque value. The predetermined maximum torque value may correspond to the predetermined pressure to be exerted by the printhead on the printing surface.

The controller may be arranged to control the first motor based upon a sensor signal indicating angular displacement of an output shaft of the first motor.

The printer may comprise a sensor arranged to generate said sensor signal indicating angular displacement of an output shaft of the first motor. The sensor may be an encoder, for example, a rotary encoder.

In the second operating mode, the first motor may be controlled based upon a sensor signal indicating angular displacement of the output shaft of the first motor. Alternatively, or additionally, in the second operating mode, the first motor may be controlled in an open loop manner, based upon a desired angular position of the output shaft of the first motor.

In the first operating mode, the first motor may be controlled based upon the sensor signal indicating angular displacement of the output shaft of the first motor.

Such control allows positional information to be provided to the controller, so as to effect closed-loop control of the first motor. In this way, appropriate control signals can be provided to the first motor so as to cause a desired torque to be generated by the first motor. For example, where the first motor is a stepper motor, a torque angle (that is, the angular offset between the stator field position and the rotor position), can be determined and the field generated by the motor windings (i.e. the stator field) can be caused to have a particular orientation. Such control can be used to maximise the torque generated for a particular magnitude of current supplied to the motor windings.

The first motor may be a position controlled motor. The first motor may be a stepper motor.

By using a sensor signal indicating angular displacement of an output shaft of the first motor as a control input, it is possible to achieve many of the benefits conventionally associated with stepper motors (e.g. high torque output, low-cost, and high-speed operation) while also providing advantageous characteristics usually associated with DC motors (e.g. a well-known relationship between the current supplied to the motor and the torque output by the motor).

In the first operation mode, the controller may be arranged to control current supplied to the windings of the first motor so as to control an orientation of a stator field of said first motor based upon a sensor signal indicating angular displacement of the output shaft of the first motor.

In this way, the torque generated by the first motor can be controlled and optimised. For example, by controlling the torque angle (that is, the angular offset between the stator field position and the rotor position) the torque can be maximised for a particular magnitude of current supplied to the motor windings. In particular, it is known that a stepper motor produces maximum torque when a torque angle of 90 (electrical) degrees is used. Thus, the control of the orientation of a stator field allows a torque angle to be controlled, which in turn allows the stepper motor to generate a maximum torque for a given winding current. Moreover, by providing accurate positional information, and controlling the stator field based upon this information, there is no risk that a stepper motor will stall if the load is greater than the maximum torque capacity.

The controller may be further arranged to control the angular position of the first motor.

Said controller may be configured to control the first motor so as to cause the output shaft of the first motor to attempt to rotate by a predetermined angular displacement.

Where the printhead is spaced apart from the printing surface, attempts by the first motor to rotate the output shaft of said first motor by a predetermined angular displacement will generally cause a corresponding rotation of the predetermined angular displacement to occur. Therefore, unless the movement of the printhead is impeded (for example by contact with the printing surface) positional control of the first motor can allow accurate positional control of the printhead.

In the second operating mode, the first motor may be configured to control the first motor so as to cause the output shaft of the first motor to attempt to rotate by a predetermined angular displacement controlled based upon a sensor signal indicating angular displacement of the first motor. Alternatively, or additionally, in the second operating mode, the first motor may be controlled in an open loop manner, based upon a desired angular position or a desired angular displacement, so as to rotate to a predetermined angular position.

Said control of angular position may be based upon a sensor signal indicating angular displacement of the first motor.

The sensor signal indicating angular displacement of the first motor may be generated by a sensor. The sensor may take any suitable form and may be, for example, a magnetic or optical encoder.

Said controller may be configured to control the first motor based upon a received target position and a received current position.

In the second operating mode, the first motor may be configured to control the first motor so as to cause the output shaft of the first motor based upon a received target position and a received current position.

Said controller may be arranged to control the angular position of the output shaft of the first motor based upon at least one of a motor speed signal and a motor current signal.

Control of the first motor so as to attempt to rotate by a predetermined angular displacement allows the first motor to be controlled in a position-controlled manner so as to move towards and press against a printing surface. By limiting the current supplied to the first motor during such position-controlled movement, it is possible to realise benefits of both positional control (e.g. a predetermined rate of movement, and ability to stop in any arbitrary position) with those of torque control (e.g. generation of a predetermined output torque which corresponds to a predetermined pressure which is to be exerted by the printhead on the printing surface during printing operations). That is, by torque-limited position-controlling the first motor, accurate control of both the printing pressure and printhead position before, during and after printing can be realised.

The predetermined angular displacement may correspond to a movement of the printhead relative to the printing surface beyond a point at which the printhead makes contact with the printing surface, such that, in use, the printing surface obstructs the output shaft of the first motor from rotating through the predetermined angular displacement.

That is, the predetermined angular displacement may be such that the mechanical arrangement of printer components makes the predetermined angular displacement impossible to achieve in use because, for example, the printhead will contact the printing surface before the predetermined angular displacement has been achieved.

The controller may be arranged to control the first motor so as to command the output shaft of the first motor to rotate until a signal indicative of actual movement of the output shaft of the first motor indicates that the predetermined angular displacement has been completed.

Said controller may be configured to control the first motor in the second operating mode to cause the printhead to maintain a position in which it is spaced apart from the printing surface by a predetermined separation.

The printhead may be caused to be maintained in a ready-to-print position in which the printhead is spaced apart from the printing surface by a small distance (e.g. 2 mm) in a position controlled mode. In this way, the printhead can be kept close enough to the printhead that it can respond quickly when printing is required, but also sufficiently spaced apart from the printing surface that the printhead will not interfere with the substrate.

Said controller may be configured to control the first motor in the first operating mode to cause the printhead to move from a position in which it is spaced apart from the printing surface towards the printing surface.

The printhead may be caused to move from a ready-to-print position in which the printhead is spaced apart from the printing surface by a small distance (e.g. 2 mm) towards the printing surface in a torque controlled mode. In this way, once a command to print is received, the controller can switch from controlling the first motor in a position controlled way, to controlling the first motor in a torque controlled way, in order to move the printhead towards the printing surface, and then cause a controlled printing force to be developed between the printing and the printing surface.

Said controller may be configured to control the first motor so as to cause the printhead to move from a position in which it is pressed against the printing surface to a position spaced apart from the printing surface in the second operating mode.

The position in which the printhead is spaced apart from the printing surface may be the ready-to-print position. Alternatively, the position in which the printhead is spaced apart from the printing surface may be a retracted position.

Controlling the magnitude of current supplied to windings of the first motor may comprise providing a pulse width modulated signal to said windings. Controlling the magnitude of current may comprise controlling a duty cycle of the pulse width modulated signal provided to said windings. Controlling the magnitude of current supplied to windings of the first motor may comprise controlling an average current supplied to said windings.

By controlling current supplied to windings of the first motor with pulse width modulation (PWM), it is possible to control the average current flowing in said windings. That is, during PWM operation the instantaneous current flowing in the motor windings will vary, but the average value can be controlled to have a desired value. Further, commutation of the windings of the first motor (such as, for example, in a brushless-DC motor) will result in the current flowing in different ones of the windings to vary in accordance with the rotational position of the output shaft of the first motor with respect to the positions of the windings, and the internal structure of the first motor. However, an average value of current flowing within all of the windings of the first motor will be indicative the overall torque generated by the first motor.

The printhead may be rotatable about a pivot and the first motor may be arranged to cause rotation of the printhead about the pivot to vary the position of the printhead relative to the printing surface.

The thermal transfer printer may further comprise a printhead assembly, the printhead assembly comprising a first arm and a second arm, the first arm being coupled to the first motor, and the printhead being disposed on the second arm. The first motor may be arranged to cause movement of the first arm, thereby causing rotation of the second arm about the pivot, and causing the position of the printhead relative to the printing surface to vary.

The first motor may be coupled to the first arm via a flexible linkage.

The term flexible linkage is not intended to imply that the coupling behaves elastically. That is, the flexible linkage may be relatively inelastic resulting in any movement of the first motor being transmitted to, and causing a corresponding movement of, the first arm, and hence the second arm and the printhead, rather than causing elastic deformation (i.e. stretching) of the flexible linkage.

The linkage may be a printhead rotation belt.

The printhead rotation belt may pass around a roller driven by the first motor such that rotation of the first motor causes movement of the printhead rotation belt, movement of the printhead rotation belt causing the rotation of the printhead about the pivot. The roller may be driven by the output shaft of the first motor, such that rotation of the output shaft of the first motor causes movement of the printhead rotation belt.

The printer may further comprise a printhead drive mechanism for transporting the printhead along a track extending generally parallel to the printing surface.

The track may extend in a direction parallel to a direction of substrate and/or ribbon transport past the printhead.

The controller may be configured to control the first motor in the second operating mode to cause the printhead to maintain a position in which it is spaced apart from the printing surface by a predetermined separation during transport of the printhead along the track extending generally parallel to the printing surface.

After the completion of the printing of an image, the printhead may be retracted to the ready to print position and moved along the track in a direction substantially parallel to the printing surface, so as to be ready to begin printing a new image.

The controller may be configured to control the first motor in the first operating mode to cause said predetermined pressure to be exerted by the printhead on the printing surface during transport of the printhead along the track extending generally parallel to the printing surface.

During the printing of an image, the printhead may be pressed against the printing surface and moved along the track in a direction substantially parallel to the printing surface, so as to print a plurality of lines of the image.

The predetermined angular displacement may be determined based upon the position of the printhead along the track extending generally parallel to the printing surface.

The printhead drive mechanism may comprise a printhead drive belt operably connected to the printhead and a second motor for controlling movement of the printhead drive belt; wherein movement of the printhead drive belt causes the printhead to be transported along the track extending generally parallel to the printing surface.

The printhead drive belt may pass around a roller driven by the second motor such that rotation of an output shaft of the second motor causes movement of the printhead drive belt, movement of the printhead drive belt causing the printhead to be transported along the track extending generally parallel to the printing surface.

The printhead drive belt may extend generally parallel to the printhead rotation belt. That is, the printhead drive belt (which is arranged to cause the printhead to be transported along the track extending generally parallel to the printing surface) may extend generally parallel to the printhead rotation belt which causes the rotation of the printhead about the pivot.

The printing surface may extend generally parallel to a direction of substrate movement and/or ribbon movement.

The second motor may be a position controlled motor. The second motor may be a stepper motor. The second motor may referred to as a printhead drive motor.

The first motor may be a DC motor. The first motor may be a brushless DC motor, such as, for example a three-phase brushless DC motor.

The printer may be a thermal printer wherein the printhead is configured to be selectively energised so as to generate heat which causes the mark to be created on the substrate.

The printer may be a thermal transfer printer wherein the printhead is configured to be selectively energised so as cause ink to be transferred from an ink carrying ribbon to the substrate so as to cause the mark to be created on the substrate.

The printer may be a thermal transfer printer further comprising: first and second spool supports each being configured to support a spool of ribbon; and a ribbon drive configured to cause movement of ribbon from the first spool support to the second spool support.

The printhead may be configured to be selectively energised so as to generate heat which causes the mark to be created on a thermally sensitive substrate.

According to a second aspect of the invention there is provided a method of controlling a printer, the printer comprising: a printhead configured to selectively cause a mark to be created on a substrate; a first motor coupled to the printhead and arranged to vary the position of the printhead relative to a printing surface against which printing is carried out to thereby control the pressure exerted by the printhead on the printing surface; and a controller arranged to control the first motor. The method comprises controlling the magnitude of current supplied to windings of the first motor so as to cause a predetermined pressure to be exerted by the printhead on the printing surface.

The controller may be arranged to control the first motor in first and second operating modes. The method may comprise, in the first operating mode, controlling the magnitude of current supplied to windings of the first motor so as to cause a predetermined pressure to be exerted by the printhead on the printing surface. The method may comprise, in the second operating mode, controlling the angular position of an output position of the first motor so as to control the position of the printhead relative to the printing surface.

The method may comprise controlling the first motor in the second operating mode to cause the printhead to maintain a position in which it is spaced apart from the printing surface by a predetermined separation.

The method may comprise controlling the first motor in the first operating mode to cause the printhead to move from a position in which it is spaced apart from the printing surface towards the printing surface.

The method may comprise, controlling the first motor so as to cause the printhead to move from a position in which it is pressed against the printing surface to a position spaced apart from the printing surface in the second operating mode.

The method may comprise controlling the first motor in the second operating mode to cause the printhead to maintain a position in which it is spaced apart from the printing surface by a predetermined separation during transport of the printhead along a track extending generally parallel to the printing surface.

The method may comprise controlling the first motor in the first operating mode to cause said predetermined pressure to be exerted by the printhead on the printing surface during transport of the printhead along the track extending generally parallel to the printing surface.

The method may comprise determining a position of the printhead in a direction parallel to the printing surface, and controlling the first motor based upon the position of the printhead in the direction parallel to the printing surface.

Controlling the magnitude of current supplied to the windings of the first motor may comprise controlling the magnitude of the current so as to not exceed a predetermined maximum value.

Controlling the magnitude of current supplied to the windings of the first motor may comprise: determining a target position of the printhead relative to the printing surface;

controlling the magnitude of current supplied to the windings of the first motor to cause the printhead to move towards the target position; and, if the current required to cause the printhead to move towards the target position exceeds the predetermined maximum value, controlling the magnitude of the current so as to not exceed the predetermined maximum value.

Controlling the magnitude of current supplied to the windings of the first motor may further comprise: determining a rotational position of an output shaft of the first motor which corresponds to the target position of the printhead; and controlling the magnitude of current supplied to the windings of the first motor to cause the output shaft of the first motor to move towards the determined rotational position.

Controlling the magnitude of current supplied to the windings of the first motor may further comprise: determining an actual position of the printhead in a direction parallel to the printing surface; wherein determining the rotational position of the output shaft of the first motor which corresponds to the target position of the printhead is based upon the actual position of the printhead in a direction parallel to the printing surface.

Any feature described in the context of one aspect of the invention can be applied to other aspects of the invention. In particular, features described in the context of the first aspect of the invention can be applied to the second aspect of the invention.

Embodiments of the invention will now be described, by way of example, with reference to the accompanying drawings, in which.

Figure 1:
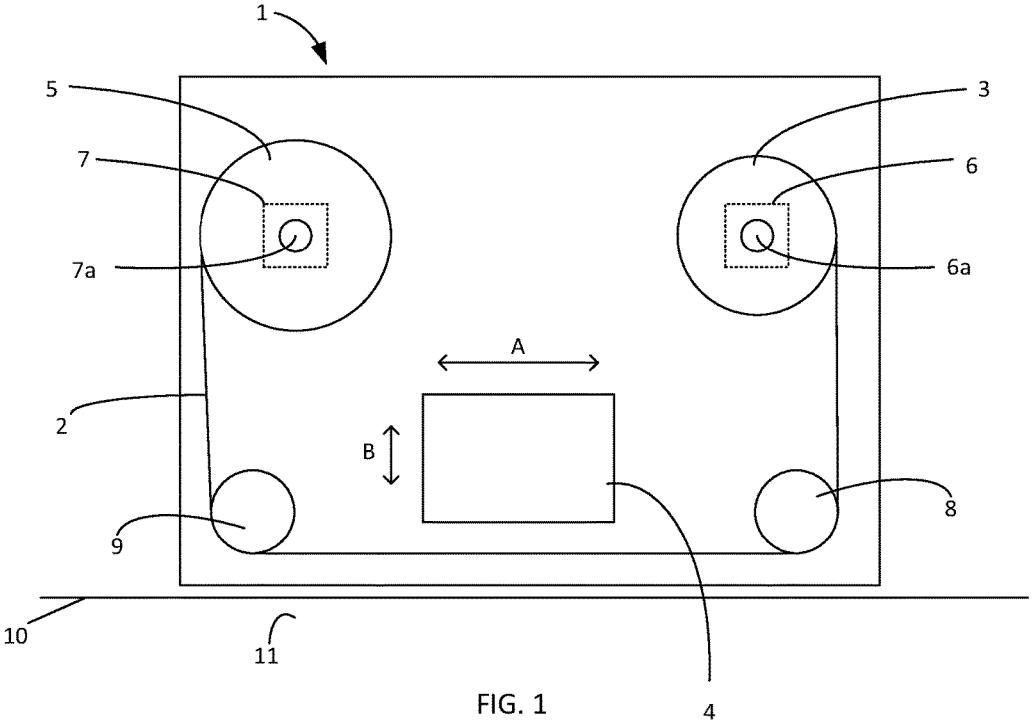
FIG. 1 is a schematic illustration of a printer in accordance with the present invention.

Referring to FIG. 1, there is illustrated a thermal transfer printer 1 in which ink carrying ribbon 2 is provided on a ribbon supply spool 3, passes a printhead assembly 4 and is taken up by a ribbon take-up spool 5. The ribbon supply spool 3 is driven by a stepper motor 6 while the ribbon take-up spool is driven by a stepper motor 7. In the illustrated embodiment the ribbon supply spool 3 is mounted on an output shaft 6*a* of its stepper motor 6 while the ribbon take-up spool 5 is mounted on an output shaft 7*a* of its stepper motor 7. The stepper motors 6, 7 may be arranged so as to operate in push-pull mode whereby the stepper motor 6 rotates the ribbon supply spool 3 to pay out ribbon while the stepper motor 7 rotates the ribbon take-up spool 5 so as to take up ribbon. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In other embodiments the ribbon may be transported from the ribbon supply spool 3 to the ribbon take up spool 5 past the printhead assembly 4 in other ways. For example only the ribbon take up spool 5 may be driven by a motor while the ribbon supply spool 3 is arranged so as to provide resistance to ribbon motion, thereby causing tension in the ribbon. That is, the motor 6 driving the ribbon supply spool 5 may not be required in some embodiments. Resistance to ribbon movement may be provided by a slipping clutch arrangement on the supply spool. In some embodiments the motors driving the ribbon supply spool 5 and the ribbon take up spool 7 may be motors other than stepper motors. For example the motors driving the ribbon supply spool 5 and the ribbon take up spool 7 may be direct current (DC) motors. In general the motors driving the ribbon supply spool 5 and/or the ribbon take up spool 7 may be torque controlled motors (e.g. DC motors) or position controlled motors (e.g. stepper motors, or DC servo motors).

Ribbon paid out by the ribbon supply spool 3 passes a guide roller 8 before passing the printhead assembly 4, and a further guide roller 9 and subsequently being taken up by the ribbon take up spool 5.

The printhead assembly 4 comprises a printhead (not shown) which presses the ribbon 2, and a substrate 10 against a printing surface 11 to effect printing. The printhead is a thermal transfer printhead comprising a plurality of printing elements, each arranged to remove a pixel of ink from the ribbon 2 and to deposit the removed pixel of ink on the substrate 10.

The printhead assembly 4 is moveable in a direction generally parallel to the direction of travel of the ribbon 2 and the substrate 10 past the printhead assembly 4, as shown by an arrow A. Further, at least a portion of the printhead assembly 4 is moveable towards and away from the substrate 10, so as to cause the ribbon 2 (when passing the printhead) to move into and out of contact with the substrate 10, as shown by arrow B.

Figure 2:
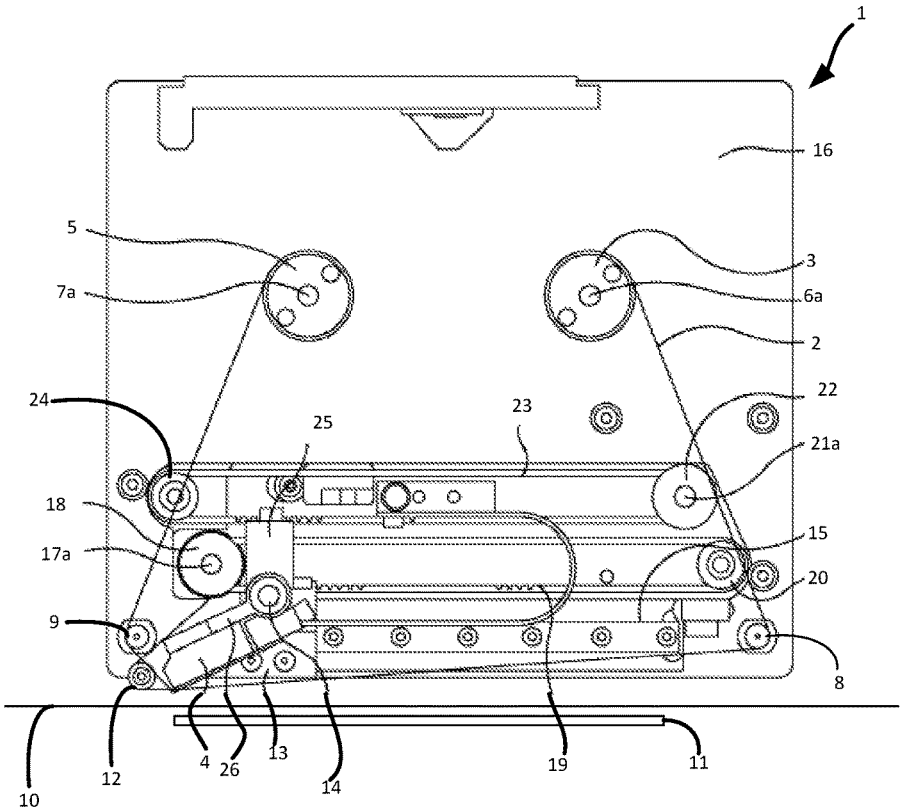
FIG. 2 is an illustration showing the printer of FIG. 1 in further detail.
Figure 3:
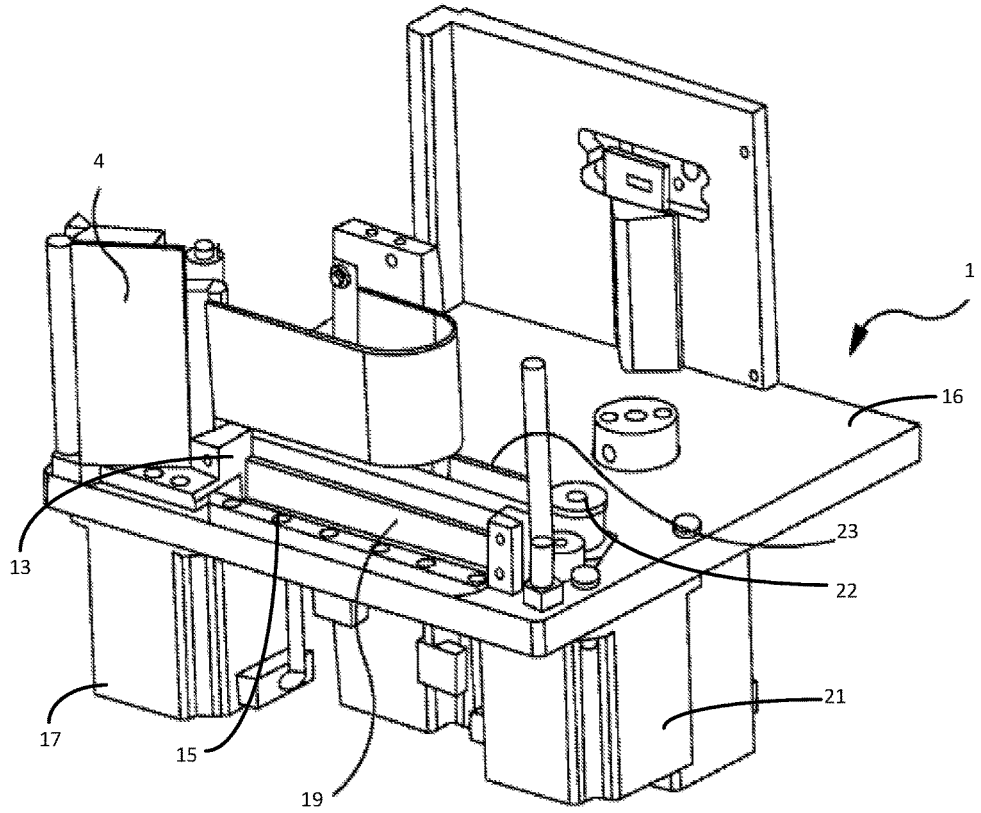
FIG. 3 is a perspective illustration showing the printer of FIG. 1 in further detail.

Referring now to FIGS. 2 and 3, the printer 1 is described in more detail. The printhead assembly 4 further comprises a guide roller 12, around which the ribbon 2 passes between the roller 9, and the printhead. The printhead assembly 4 is pivotally mounted to a printhead carriage 13 for rotation about a pivot 14 thereby allowing the printhead to be moved towards or away from the printing surface 11. The printhead carriage 13 is displaceable along a linear track 15, which is fixed in position relative to a base plate 16 of the printer 1.

The position of the printhead carriage 13 in the direction of ribbon movement (and hence position of the printhead assembly 4) is controlled by a motor 17 (see FIG. 3). The motor 17 is located behind the base plate 16 and drives a pulley wheel 18 that is mounted on an output shaft 17*a* of the motor 17. The pulley wheel 18 in turn drives a printhead drive belt 19 extending around a further pulley wheel 20. The printhead carriage 13 is secured to the printhead drive belt 19. Thus rotation of the pulley wheel 18 in the clockwise direction drives printhead carriage 13 and hence the printhead assembly 4 to the left in FIG. 2 whereas rotation of the pulley wheel 18 in the counter-clockwise direction in FIG. 2 drives the printhead assembly 4 to the right in FIG. 2.

The movement of the printhead towards and away from the printing surface 11 (and hence the pressure of the printhead against the ribbon 2, the substrate 10, and the printing surface 11) is controlled by a motor 21. The motor 21 is also located behind the base plate 16 (see FIG. 3) and drives a pulley wheel 22 that is mounted on an output shaft of the motor 21. The pulley wheel 22 in turn drives a printhead rotation belt 23 extending around a further pulley wheel 24. The printhead assembly 4 comprises a first arm 25, and a second arm 26, which are arranged to pivot about the pivot 14. The first arm 25 is connected to the printhead rotation belt 23, such that when the printhead rotation belt 23 moves the first arm 25 is also caused to move. The printhead is attached to the second arm 26. Assuming that the pivot 14 remains stationary (i.e. that the printhead carriage 13 does not move), it will be appreciated that movement of the printhead rotation belt 23, causes movement of the first arm 25, and a corresponding movement of the second arm 26 about the pivot 14, and hence the printhead. Thus rotation of the pulley wheel 22 in the clockwise direction drives the first arm 25 in to the left in FIG. 2, causing the second arm 26 to move in a generally downward direction, and the printhead assembly 4 to move towards the printing surface 11. On the other hand, rotation of the pulley wheel 22 in the counter-clockwise direction in FIG. 2 causes the printhead assembly 4 to move away from the printing surface 11.

The belts 19, 23 may be considered to be a form of flexible linkage. However, the term flexible linkage is not intended to imply that the belts behave elastically. That is, the belts 19, 23 are relatively inelastic in a direction generally parallel to the direction of travel of the ribbon 2 and the substrate 10 past the printhead assembly 4 (i.e. the direction which extends between the pulley wheel 22 and the further pulley wheel 24).

It will be appreciated, of course, that the belts 19, 23 will flex in a direction perpendicular to the direction of travel of the ribbon 2 and the substrate 10 past the printhead assembly 4, so as to allow the belts 19, 23 to move around the pulleys 18, 20, 22, 24. Further, the printhead rotation belt 23 will flex in a direction perpendicular to the direction of travel of the ribbon 2 and the substrate 10 past the printhead assembly 4, so as to allow for the arc of movement of the first 25 arm about the pivot 14. However, in general, it will be understood that the relative inelasticity ensures that any rotation of the pulley wheel 22 caused by the motor 21 is substantially transmitted to, and causes movement of, the first arm 25, and hence the printhead. The belts 19, 23 may, for example, be polyurethane timing belts with steel reinforcement. For example, the belts 19, 23 may be AT3 GEN III Synchroflex Timing Belts manufactured by BRECOflex CO., L.L.C., New Jersey, United States.

The arc of movement of the printhead with respect to the pivot 14 is determined by the location of the printhead relative to the pivot 14. The extent of movement of the printhead is determined by the relative lengths of the first and second arms 25, 26, and the distance moved by the printhead rotation belt 23. Thus, by controlling the motor 21 to cause the motor shaft (and hence pulley wheel 22) to move through a predetermined angular distance, the printhead can be moved by a corresponding predetermined distance towards or away from the printing surface 11.

It will further be appreciated that a force applied to the first arm 25 by the printhead rotation belt 23 will be transmitted to the second arm 26 and the printhead. Thus, if movement of the printhead is opposed by it coming into contact with a surface (such as, for example, the printing surface 11), then the force exerted by the printhead on the printing surface 11 will be determined by the force exerted on the first arm 25 by the printhead rotation belt 23—albeit with necessary adjustment for the geometry of the first and second arms 25, 26. Further, the force exerted on the first arm 25 by the printhead rotation belt 23 is in turn determined by the torque applied to the printhead rotation belt 23 by the motor 21 (via pulley wheel 22).

Thus, by controlling the motor 21 to output a predetermined torque, a corresponding predetermined force (and corresponding pressure) can be established between the printhead and the printing surface 11. That is, the motor 21 can be controlled to move the printhead towards and away from the printing surface 11, and thus to determine the pressure which the printhead applies to the printing surface 11. The control of the applied pressure is important as it is a factor which affects the quality of printing.

The description above assumes that the pivot 14 is stationary as the printhead is moved towards and away from the printing surface 11. Such an arrangement may, for example, be used to effect continuous printing. However, in some printing modes, such as, for example, intermittent printing, it is required for the printhead to move in the direction of substrate movement during a printing operation. Such movement is effected by moving the carriage 13 along the linear track 15 under the control of the motor 17, as described above.

However, it will be appreciated that any movement of the printhead carriage 13, without a corresponding movement of the printhead rotation belt 23 will cause the first and second arms 25, 26 of the printhead assembly 4 to rotate about the pivot 14, moving the printhead towards or away from the printing surface 11. Thus, to ensure a stable printhead pressure and position during printhead movement, it is necessary to control the motors 17, 21 so as to drive the printhead drive and printhead rotation belts 19, 23 in a coordinated manner.

The movement of the printhead towards and away from the printing surface when the position of the pivot 14 is also moving is carried out in a similar manner to the situation described above where the position of the pivot 14 is fixed. However, control of motor 21, and thus control of the movement of the printhead rotation belt 23, is carried out relative to the position of the printhead drive belt 19, rather than to any fixed datum on the base plate 16.

For example, in order to maintain a predetermined separation between the printhead and the printing surface 11 during movement of the printhead carriage 13 along the linear track 15, the printhead rotation belt 23 should be controlled to move the same amount as the printhead drive belt 19. On the other hand, to maintain a predetermined pressure between the printhead and the printing surface 11 during movement of the printhead carriage 13 along the linear track 15, care should be taken to ensure that the printhead rotation belt 23 is controlled to move as the printhead drive belt 19 moves, while still providing a force to the first arm 25 which is sufficient to generate the predetermined printhead pressure.

Such control can be achieved, regardless of the position of the printhead rotation belt 23 with respect to the printhead drive belt 19, if the motor 21 is controlled to output a predetermined torque. This results in a predetermined pressure (which corresponds to the predetermined torque) being established between the printhead and the printing surface 11. That is, if the motor 21 is operated as a torque-controlled motor, the output shaft of the motor 21 (and hence the pulley 22 and printhead rotation belt 23) will be rotated so as to maintain the motor output torque at the predetermined level, regardless of the position of the printhead carriage 13 on the linear track 15, or even during movement of the printhead carriage 13. In this way, printhead pressure can be controlled with reference to a single control parameter of the motor 21, regardless of the printhead carriage position or movement state.

In some embodiments the motor 21 is a DC motor, such as, for example, a brushless DC motor (BLDC). For example, the DC motor may be a BLDC motor having a rated voltage of around 36 volts and a no-load speed of around 3500 revolutions per minute. Further, the DC motor may, for example, be capable of generating a rated-torque of around 500 milli-Newton-metres while drawing around 5 amperes current, and a starting torque of around 800 milli-Newton-metres while drawing around 8 amperes of current. The DC motor may, for example, comprise internal drive electronics arranged to control commutation of the windings of the motor. Of course, motors having specifications other than this may also be selected as appropriate for each particular application. Moreover, motor operating characteristics can be altered or optimised by use of a gearbox coupled to the motor.

DC motors of this type generally exhibit a well-known relationship between the current supplied to the motor and the torque output by the motor. Therefore, by providing a predetermined current to the motor 21, a corresponding predetermined torque can be generated at the output shaft of the motor, resulting in a predetermined pressure being established between the printhead and the printing surface 11.

That is, by appropriate control of the current supplied to the motor 21, the torque generated by the motor 21, and hence the printhead pressure can be controlled to a predetermined value.

Control of the printhead pressure by torque control of the motor 21 allows the printhead to be controllable to be either 'in', or 'out'. That is, the motor 21 is driven in a torque-control mode in either a clockwise, or an anti-clockwise direction, with no control as to the position. When driven 'in' the printhead moves until it reaches a physical stop, after which the motor 21 will continue to generate a predetermined retract torque, but will not move any further due to the presence of the physical stop (described in more detail below). On the other hand, when the printhead is driven 'out' the printhead moves outwards until it reaches the printing surface 11, after which the motor 21 will continue to generate a predetermined printing torque, but will not move any further due to the presence of the printing surface 11 (also described in more detail below).

The operation of the printer 1 as briefly described above is now described with reference to FIG. 4. The processing described is carried out by a controller (not shown) associated with the printer 1. Processing begins at step S1, where initialisation actions may be carried out. Once complete, processing passes to step S2 where the printer 1 is in a standby, or ready-to-print condition. In such a state, the printhead is withdrawn from the printing surface, and the controller is waiting for a 'print' command to be received. While no 'print' command is received, processing loops around step S2.

When a 'print' command is received by the controller processing passes to step S3, and the motor 21 is energised to move in a clockwise direction and to deliver a predetermined torque (i.e. with a predetermined current flowing through the motor windings), so as to cause the printhead assembly 4 to move towards the printing surface 11. Once contact is made between the printhead and the printing surface 11, the printhead exerts a pressure on the printing surface which corresponds to the predetermined torque set for the motor 21. Once the contact pressure has stabilised, processing passes to step S4. At step S4, where intermittent printing is to be carried out, the motor 17 is energised so as to cause the printhead drive belt 19 to move, moving the printhead carriage 13 along the linear track 15, causing the printhead to move parallel to the printing surface 11. Once the required movement speed of the printhead carriage has been established, processing passes to step S5, where printing is carried out. The printhead is energised as it passes along the printing surface 11, transferring ink to the substrate 10 as required.

Where continuous printing is required to be carried out (as opposed to intermittent printing), step S4 can be omitted, and processing can pass directly from step S3 to step S5.

Once printing is complete, processing passes step S6, where the motor 21 is controlled so as to be energised in the reverse direction (i.e. anti-clockwise) with a predetermined retract torque, causing the printhead assembly 4 to be moved away from the printing surface 11. A physical stop (not shown) is provided to prevent the printhead assembly 4 moving more than a predetermined distance from the printing surface 11. That is, when the motor 21 is controlled in a torque-controlled mode, it can operate only to drive the printhead carriage 4 in a particular direction (i.e. towards or away from the printing surface 11). Thus, the stop is provided to prevent the printhead assembly 4 (and thus the printhead) from moving too far from the printing surface 11. The physical stop is arranged to stop the printhead carriage 4 at a distance from the printing surface 11, in a retracted position. The retracted position allows for safe movement of the substrate 10, and for system maintenance to be carried out without risk of damage to the printhead, ribbon 2 or substrate 10. For example, the retracted position allows for the ribbon 2 to be threaded through the printer 1 without any interference from the printhead. Further, it will be appreciated that some substrates may not be flat, and may comprise raised portions, which could cause damage to the printhead if they were to come into contact. As such, the retracted position is selected so as to be far enough from the printing surface 11 (and also substrate 10) so as to avoid any such contact.

Once the printhead assembly 4 abuts the stop, the motor 21 will continue to generate the retract torque, however movement will cease. Therefore, by appropriate choice of a retract torque value, the printhead assembly 4 can be made to press against the stop with a predetermined retract force, maintaining the printhead assembly 4 in the retracted position until it is required to print once again. It will be appreciated that the retract force may be selected so as to be less than the printing force. That is, maintaining the printhead assembly 4 in the retracted position may require a smaller force (and a correspondingly smaller torque) than is required to achieve high quality printing.

Once the printhead assembly is retracted, processing passes to step S7, where the printhead carriage 13 is moved, by appropriate control of the motor 17 to be ready for a subsequent printing operation. For example, the printhead carriage 13 may be moved along the linear track 15 in the opposite direction to the direction of movement during a printing operation. Of course, where continuous printing is carried out, step S7 may be omitted (as with step S4). Processing then passes to step S8, where it is determined whether more printing is required. If yes, processing returns to step S2, where a next 'print' command is awaited. On the other hand, if no more printing is required, processing terminates at step S9.

While the control of the printhead pressure by torque control of the motor 21 described with reference to FIG. 4 may provide a degree of control, it does not allow for the printhead to be maintained in an arbitrary position which is close to the printing surface 11 (other than when pressed against the stop). Thus, the provision of a 'ready to print' location for the printhead, which is close to, but separated from, the printing surface is not possible when the motor 21 is controlled by torque control alone. That is, while the retracted position described above allows any unwanted contact with the substrate to be avoided, this position necessarily results in there being significant separation between the printhead and the substrate 10. Thus, when a 'print' command is received, this distance must be closed by movement of the printhead assembly 4 towards the substrate 10 (and printing surface 11). However, such movement, if performed sufficiently quickly so as to allow high speed printing, may result in the printhead bouncing upon making contact with the printing surface 11, requiring further time to be waited until a stable printing pressure is established.

However, in an alternative control mode the DC motor 21 is controlled by a closed loop position controller, which is also provided with a torque limit, allowing a ready to print position to be provided.

Figure 5:
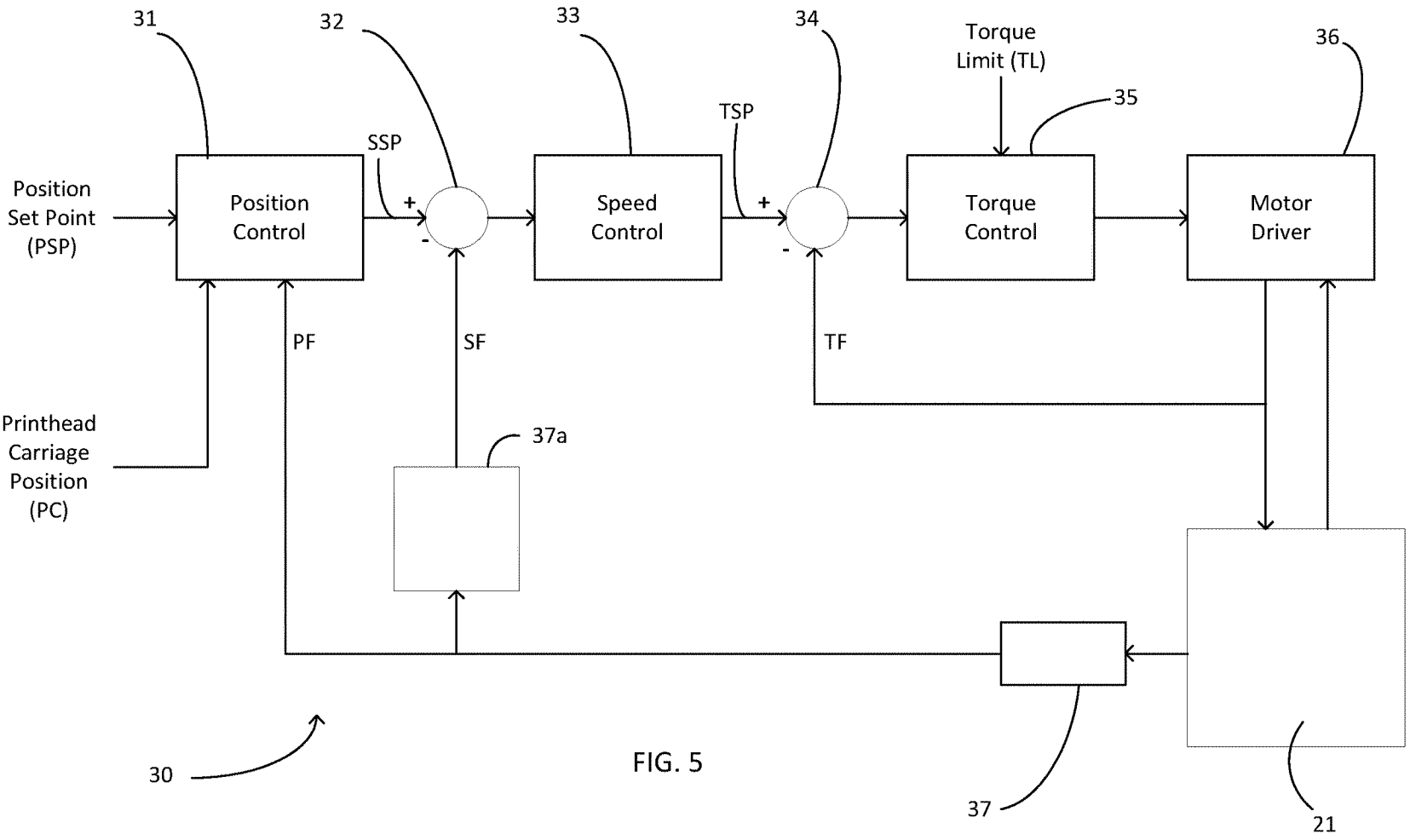
FIG. 5 is a schematic illustration of a controller arranged to control components of the printer of FIG. 1.

FIG. 5 illustrates a controller 30 which is arranged to provide combined torque and positional control of the motor 21. The controller 30 comprises a position controller 31, a speed set point adder 32, a speed controller 33, a current set point adder 34, a torque controller 35 and a motor driver 36. The controller 30, and more particularly the position controller 31 receives, as an input, a position set point signal PSP. For example, the position set point signal may take the form of a signal indicating that the printhead should be moved to one of the ready-to-print position, the printing position or the home (retracted) position. The position controller 31 also receives as a second input a position feedback signal PF which is indicative of the rotary position of the motor 21.

The position feedback signal PF is generated by an encoder 37 which is attached to the motor 21 and which generates an output which accurately represents the position of the motor 21. The encoder 37 may for example be a magnetic encoder comprising a magnet which is mounted so as to rotate with the output shaft of the motor 21, and whose field is sensed by a Hall-effect sensor encoder chip. The Hall-effect sensor encoder chip may, for example, generate around 1000 pulses per revolution. The encoder may suitably provide an output which is either an absolute encoder position output via a serial interface, or a pseudo-quadrature encoder output. A suitable Hall-effect sensor may, for example, be provided by a component having part number AS5040 manufactured by Austria Microsystems.

Alternatively, the position feedback signal PF may be generated by internal components of the motor 21, or by any components which generate an output which accurately represents the angular position of the motor 21. Hall-effect sensors which are routinely incorporated into BLDC motors for commutation purposes may not provide sufficient resolution at low speeds to accurately control the position of the motor 21. As such, an additional encoder (such as that described above) may be preferred.

It will further be appreciated that the position feedback signal PF may be generated by any components which generate an output which accurately represents the position of the printhead assembly 4.

The position controller 31 also receives as a third input a printhead carriage position signal PC which is indicative of the position of the printhead carriage 13. The printhead carriage position signal PC may be generated based upon the number of steps through which the motor 17 has moved. For example, the printhead carriage position signal PC may be based upon a control signal supplied to the motor 17. In combination the printhead carriage position signal PC and the position feedback signal PF allow the actual position of the printhead relative to the printing surface 11 to be calculated.

The position controller 31 generates as an output a motor speed set point signal SSP which is based upon the position set point signal PSP, the printhead carriage position signal PC and the position feedback signal PF (which signals, taken together, are indicative of the actual position of the printhead carriage 13, and the actual position of the printhead assembly). The speed set point signal SSP is adjusted during the subsequent movement of the printhead assembly 13 so as to ensure that the movement is controlled in an appropriate manner. For example, when an instruction is received to cause the printhead to be moved into contact with the printing surface 11 from the ready to print position, the position controller 31 initially generates a series of speed set point signals SSPs which take the form of a increasing ramp, having a rate of increase (i.e. acceleration) which is known to be within the capabilities of the motor 21 and motor driver 36 in combination with the load (i.e. the printhead assembly 4). Once the generated speed set point SSP characteristic reaches a predetermined maximum speed, the speed set point characteristic becomes flat—maintaining the predetermined maximum speed. Further, once the actual position of the printhead assembly 4 approaches the printing surface 11, a deceleration ramp may be generated, causing the motor 21 to be decelerated before contact is made, reducing the likelihood of printhead bounce.

Thus, the position feedback signal PF is used by the position controller 31 as an index to a set of predetermined movement profile functions. Each movement profile function may, for example, comprise an acceleration ramp, a maximum speed, and a deceleration ramp. It will be appreciated that the characteristics of the various movement profiles are dependent upon the purpose of that profile (e.g. move in to ready-to-print, move in to printing position, move out to ready-to-print position, etc.), and also dependent upon various characteristics of the printer 1. For example, different movement profiles may be required for use with different printhead widths.

In some embodiments, the position controller 31 may comprise a simple closed loop position controller having a set point adder which subtracts an actual position signal (as indicated by the position feedback signal PF) from a position set point generating a position error signal, which is provided to a proportional-integral controller (which may itself limit maximum acceleration/speed etc.).

The output of the position controller 31 (i.e. the speed set point signal SSP) is provided to the speed set point adder 32, which also receives a speed feedback signal SF. The speed feedback signal SF is generated, based upon the output of the encoder 37, by a speed convertor 37*a*. The speed convertor 37*a* converts pulses generated by the encoder 37 into a signal indicative of the rotational speed of the motor 21.

The speed set point adder 32 subtracts the speed feedback signal SF from the speed set point signal SP generating a speed error signal, which is provided to the speed controller 33. The speed controller 33 may, for example, take the form of a proportional-integral (PI) controller, and is arranged to generate, as an output a torque set point signal TSP which causes the motor 21 to be operated so as to minimise the difference between the speed set point SSP, and the speed feedback signal SF (i.e. to minimise the speed error signal).

The output of the speed controller 33 (i.e. the torque set point signal TSP) is in turn provided to the torque set point adder 34, which also receives a torque feedback signal TF which is indicative of the torque being generated by the motor 21. It is well known that the torque produced by a DC motor is proportional to the current flowing in the windings. The torque feedback signal may thus be generated by monitoring the current flowing in the windings of the motor 21.

The torque set point adder 34 subtracts the torque feedback TF signal from the torque set point signal TSP generating a torque error signal, which is provided to the torque controller 35. The torque controller 35 is arranged to generate, as an output a motor control signal which is provided to the motor driver 36. The torque controller 35 may, for example, take the form of a proportional-integral (PI) controller and is operated so as to minimise the difference between the torque set point signal TSP, and the torque feedback signal TF (i.e. to minimise the torque error signal). Thus, if the generated torque is smaller than the torque set point, the motor 21 is caused to generate more torque, and vice versa.

The torque controller 35 also receives, as an input, a torque limit signal TL, which corresponds to the maximum torque to be generated by the motor 21. This torque limit signal TL is determined to correspond to a predetermined printhead contact force. The torque limit signal TL is used to prevent the printhead contact force from exceeding the predetermined printhead contact force. That is, even if the torque required to correct a speed error signal is greater than the torque limit TL, the torque controller 35 is prevented from generating a signal which would cause the motor to generate that level of torque. For example, when the torque error signal is sufficiently large to cause the output of the torque controller 35 to exceed the torque limit TL the output may be simply limited to a maximum value which corresponds to the torque limit TL.

It will be appreciated that if the motor 21 is position-controlled so as to attempt to drive the printhead to a target position which is beyond the printing surface 11 (which target cannot be achieved due to the presence of the printing surface 11) the motor 21 will drive the printhead as far as possible until it meets the printing surface 11, at which point the torque generated by the motor 21 will rise to the maximum torque that can be output by the motor 21. Such operation could result in large printhead force being generated between the printhead and the printing surface. However, the arrangement described above allows the maximum torque generated by the motor 21 (i.e. the torque limit TL) to correspond to a predetermined printhead force being generated between the printhead and the printing surface 11. Therefore, if a target position is set which is beyond the printing surface 11, the printhead force can be controlled by appropriate choice of a torque limit TL. That is, in a torque-limited position-controlled mode the motor 21 can be used to position-control the printhead, while also delivering a predetermined torque, which corresponds to the predetermined printing pressure.

It will be appreciated that the torque limit TL may be varied in dependence upon characteristics of the printhead assembly 4, or the printhead (e.g. printhead width). Further, the torque limit TL may be varied during movement of the printhead so as to accommodate different torque requirements during acceleration, deceleration and stationary operation. For example a larger torque limit TL may be required during acceleration from a stationary position than is required to maintain a predetermined printhead force. As such, the torque controller 35 may generate a dynamic torque limit, which takes the form of a torque limit profile. The torque controller 35 may vary such a torque limit (e.g. by indexing the profile) based upon the actual position of the printhead, or the actual speed of the printhead (as indicated by the position feedback signal PF and speed feedback signal SF respectively).

The motor driver 36 converts the motor control signal generated by the torque controller 35 into pulse width modulated (PWM) signals which are supplied to the motor windings. The duty cycle of the PWM signals is controlled so as to generate more or less torque, as required by the torque controller 35.

As described above the torque feedback signal may be generated based upon the current flowing within the windings of the motor 21. The current may, for example, be monitored by way of a low-value shunt resistor which is arranged in series with the common ground connection for the power stage of the motor driver 36.

Figure 6:
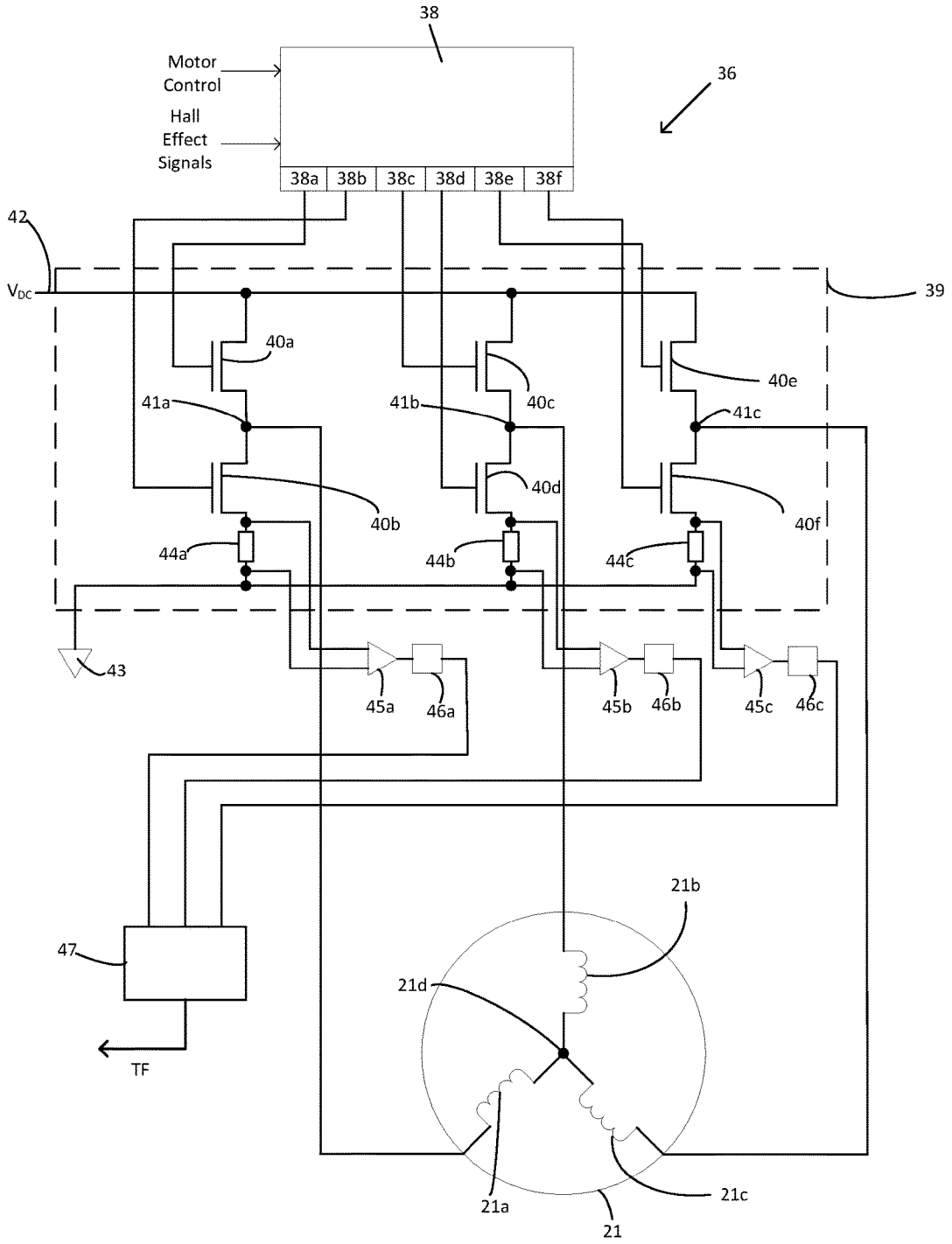
FIG. 6 is a schematic illustration of a part of the controller of FIG. 5.

FIG. 6 shows the components of the motor driver 36 in more detail. In particular, the motor driver 36 comprises a PWM block 38 which receives as inputs the motor control signal generated by the torque controller 35 and the output of Hall-effect sensors embedded in the motor 21 which are configured to generate an output indicative of the current rotational position of the rotor of the motor 21. The PWM block uses these signals to generate PWM output signals Q1 to Q6. The duty cycle of the PWM signals is controlled based upon the motor control signal, while the commutation of the output signals Q1 to Q6 is controlled based upon the output of the Hall-effect sensors.

Motor driver 36 further comprises a power stage 39 which comprises six power transistors 40*a* to 40*f* arranged in series pairs (40*a* and 40*b*, 40*c* and 40*d*, and 40*e* and 40*f*), each pair having an intermediate node 41*a*, 41*b*, 41*c* between the two transistors of that pair. The three pairs of transistors are arranged in parallel between a DC power supply 42 and a ground connection 43. Each pair of transistors comprises an upper transistor 40*a*, 40*c*, 40*d* and a lower transistor 40*b*, 40*d*, 40*f* which are arranged to provide three parallel connections between the DC power supply 42 and the ground connection 43. As is common-place in PWM motor drives, free-wheel diodes may be associated with each of the transistors 40*a*-40*f*, allowing current to continue flowing in the windings when the transistors 40*a*-40*f* are switched off.

The intermediate nodes 41*a*, 41*b*, 41*c* are each connected to a first end of a respective one of three windings 21*a*, 21*b*, 21*c* of the motor 21. A second end of each of the three windings 21*a*, 21*b*, 21*c* of the motor 21 is connected together at a node 21*d*.

In operation each of the transistors 40*a* to 40*f* is controlled by a respective one of the output signals 38*a* to 38*f* so as to cause the motor windings 21*a* to 21*c* to be sequentially energised in accordance with the desired torque, and present rotational position according to well-known commutation and PWM techniques. The motor windings 21*a* to 21*c* may, for example, be energised according to trapezoid or sinusoidal waveforms.

The current flowing through the windings 21*a* to 21*c* returns through one of the lower transistors 40*b*, 40*d*, 40*f*, via a respective low value shunt resistor 44*a*, 44*b*, 44*c* to a ground connection 43. Each of the low value shunt resistors 44*a*, 44*b*, 44*c* may, for example be, a resistor having a resistance of around 0.3 ohm. Voltages developed across the each of resistors 44*a*, 44*b*, 44*c* are monitored via amplifiers 45*a*, 45*b*, 45*c*. Each of the amplifiers 45*a*, 45*b*, 45*c* generates an output which is indicative of the voltage developed across a respective one of the resistors 44*a*, 44*b*, 44*c*. The voltages developed across the resistors 43*a*, 43*b*, 43*c* are proportional to the current flowing through a respective one of the windings 21*a*, 21*b*, 21*c* according to Ohm's law.

The amplifiers 45*a*, 45*b*, 45*c* may, for example, be high-speed rail-to-rail operational amplifiers, which are configured with an offset such that the output is biased to be approximately half-way between the ground level and the voltage supply level. That is, the output of the amplifiers 45*a*, 45*b*, 45*c* can swing in both positive and negative directions from the bias position, allowing both positive and negative voltages developed across the resistors 44*a*, 44*b*, 44*c* to be detected.

As described above, during operation the motor windings 21*a* to 21*c* are energised according to well-known commutation and PWM techniques. As such, during PWM "on" periods, a current will flow from the power supply 42, through a respective one of the upper transistors 40*a*, 40*c*, 40*e*, through the windings 21*a*, 21*b*, 21*c*, through a respective one of the lower transistors 40*b*, 40*d*, 40*f*, before flowing through respective one of the resistors 44*a*, 44*b*, 44*c*, thereby generating a positive voltage across a said one of the resistors 44*a*, 44*b*, 44*c*. On the other hand, during the PWM "off" periods, the motor windings 21*a*, 21*b*, 21*c* will act as generators, and current will be conducted through the free-wheel diodes which are associated with each of the transistors 40*a*-40*f*. This free-wheel current will result in a negative voltage being developed across the resistors 44*a*, 44*b*, 44*c* during the PWM "off" periods. The above-described amplifier configuration allows such negative voltages to be measured during the PWM "off" periods, as well as the positive voltages during PWM "on" periods.

Outputs of the amplifiers 45*a*, 45*b*, 45*c* are provided to analog-to-digital convertors (ADCs) 46*a*, 46*b*, 46*c*. Each of the analog-to-digital convertors (ADCs) 46*a*, 46*b*, 46*c* converts a voltage signal output by a respective one of the amplifiers 45*a*, 45*b*, 45*c* to a digital signal which is indicative of the voltage developed across a respective one of the resistors 43*a*, 43*b*, 43*c*.

The ADC outputs are provided to inputs of a controller 47, which may, for example, take the form of a digital-signal-processor (DSP) or a microcontroller having fast signal processing capabilities. The controller 47 digitally processes the ADC output signals to generate a measure of the average current flowing in the windings 21*a*, 21*b*, 21*c*. That is, the effect of any offset voltage introduced by the amplifiers 45*a*, 45*b*, 45*c* (so as to allow for detection of positive and negative voltages) is removed. Thus, the controller 47 performs processing to generate digital signals which are indicative of the absolute negative and positive voltages which are generated as a result of the PWM control of the windings 21*a*, 21*b*, 21*c*. These digital signals are further processed by the controller 47 so as to calculate an effective average current flowing through each of the windings 21*a*, 21*b*, 21*c* at any point in time. Such processing may involve rectifying the positive and negative voltages measured across the resistors, so as to reflect the magnitude of current flow within the windings 21*a*, 21*b*, 21*c* (which does not change direction between PWM pulses, unlike the resistor current). Such processing may further involve performing filtering or averaging, for example, so as to remove unwanted measurement artefacts. The processed current values may be combined (e.g. by averaging) so as to form a single current value which is indicative of the current flowing within the windings 21*a*, 21*b*, 21*c*. The processed current values are then provided to the torque adder 34 as the torque feedback signal.

It will be appreciated that additional components may be providing to perform signal conditioning between the resistors 44*a*, 44*b*, 44*c* and the torque adder 34. For example, any of the processing described above as being performed in the digital domain may instead be performed in the analog domain. For example, the voltage signal may be rectified at the output of the amplifiers 45*a*, 45*b*, 45*c*. Alternatively, or in addition, level translators may be used so as to generate an appropriate signal offset. Similarly low pass filters may be used so as to remove unwanted high frequency components from the signal waveform. Further, the ADCs 46*a*, 46*b*, 46*c* may be provided as discrete components, or as part of an input stage of the controller 47. Moreover, the controller 47 may itself be part of the controller 30.

The controller 30 can thus be operated, as described above, to cause the motor 21 to operate in a torque-limited position control mode. As such, the motor 21 can be operated to hold the printhead in any arbitrary position (with a limited torque), or move between positions. Such positions may include the ready-to-print position, the printing position and the home position.

Further, the motor can be used to position control the printhead during printing, while also delivering a predetermined torque, which corresponds to the predetermined printing pressure.

Once printing is complete, the printhead can be withdrawn, under positional control, to a ready to print position. Alternatively when printing is complete, the printhead can be withdrawn to the home position (which may or may not be provided with a physical stop).

Processing carried out to control the printhead position and pressure in this way by control of the motors 17 and 21 is carried out as described with reference to FIG. 7. Processing begins at step S10 where an initialisation process is carried out. The initialisation process includes identifying the current position of the printhead assembly by use of a known datum position and the encoder. During this initialisation process the motor 21, may, for example, be controlled so as to move the printhead assembly 4 about the pivot 14 until the printhead assembly 4 is in a position where it abuts a physical stop (such as the physical stop described above with reference to torque controlled operation), and/or where it is in contact with the printing surface 11. Such end positions may be detected by monitoring the current supplied to the motor 21 during movement (for example using the resistor 45). The current will rise as soon as the movement of the printhead assembly 4 is obstructed by contact with a physical barrier (such as to the stop, or the printing surface 11), as the torque output of the motor increases. In this way, the controller determines a current position of the printhead assembly 4, and can monitor subsequent movements relative to that position with reference to the output of the encoder 37.

Once initialisation is complete, processing passes to step S11 where the printer 1 is placed in a standby, or ready-to-print condition. The printhead moved to the ready-to-print position, so as to be ready to print immediately when a print command is received. The ready-to-print position corresponds to a position which is a known number of encoder pulses away from the printing position. As such, once initialisation has been completed at step S10, the printhead can be moved to, and maintained in, the ready to print position under positional control.

Processing then passes to step S12, where the printer waits for a print command to be received. While no 'print' command is received, processing loops around step S12. When a 'print' command is received by the controller processing passes to step S13, and the motor 21 is energised to move to a target position which is beyond the contact point between the printing surface 11 and the printhead. The use of such a target position causes the motor to rotate such that the printhead assembly 4 is moved towards the printing surface 11. Once contact is made between the printhead and the printing surface 11, the printhead exerts a pressure on the printing surface which corresponds to the maximum torque set for the motor 21 (i.e. the torque limit). That is, although the actual position has not reached the target position, the torque limit provided by the torque controller 35 prevents the motor 21 from generating any more torque than the predetermined torque limit.

Once the contact pressure has stabilised (for example after a predetermined stabilisation period determined by experimentation) processing passes to step S14. At step S14, where intermittent printing is to be carried out, the motor 17 is energised so as to cause the printhead drive belt 19 to move, moving the printhead carriage 13 along the linear track 15, causing the printhead to move parallel to the printing surface 11. It will also be appreciated that such movement of the printhead carriage 13 will also cause the printhead assembly 4 to be moved. However, the controller 30, and more particularly the position controller 31 is arranged to control the printhead movement (by generation of an appropriate speed set point signal) such that movement of the printhead corresponds to the movement of the printhead carriage 13. That is, at any point during the movement of the printhead carriage 13, the printhead target position will correspond to a target position which is beyond the contact point between the printing surface 11 and the printhead, and the contact pressure will be maintained at a value which corresponds to the maximum torque set for the motor 21

Figure 8:
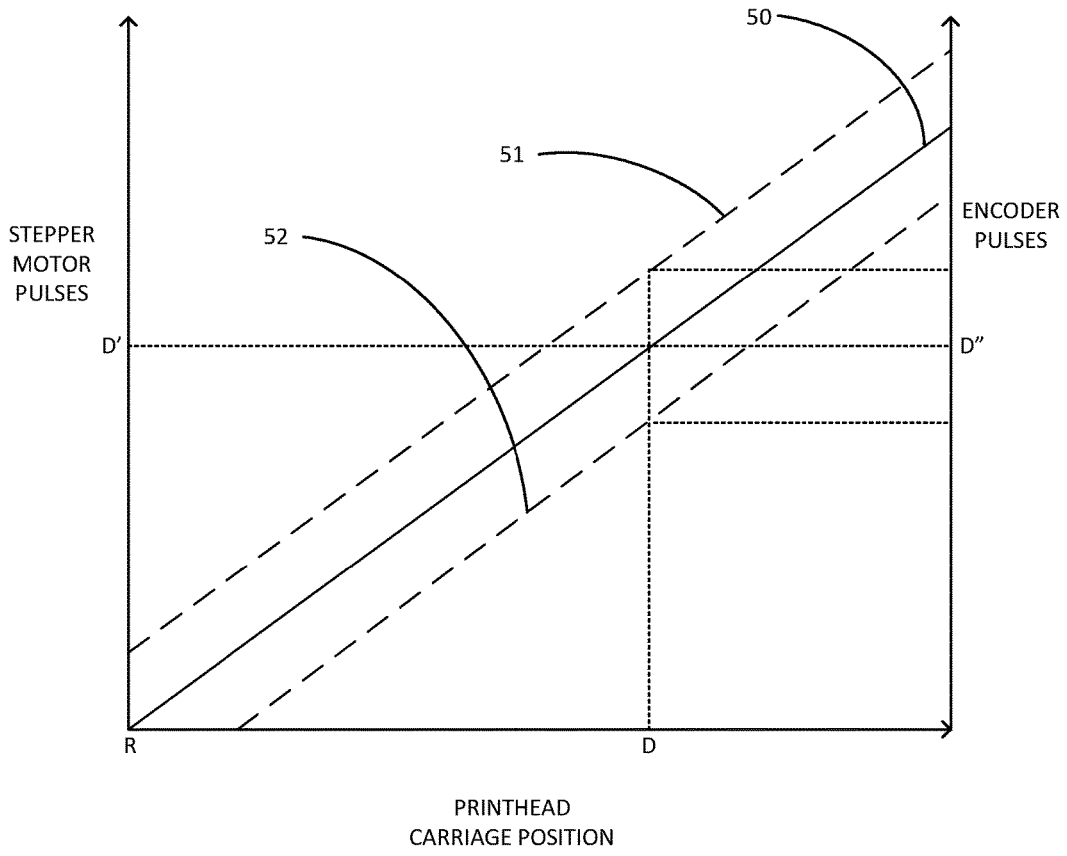
FIG. 8 is a graph showing the relationship between the actual position of the printhead and the target position of the printhead during printing operations.

FIG. 8 shows a relationship between the movement of the stepper motor 17 (which controls the movement of the printhead carriage 13) and the target position of the printhead assembly 4. The x-axis represents the position of the printhead carriage 13, and hence the lateral position of the printhead in the direction of substrate movement (i.e. in the direction indicated by arrow A in FIG. 1). A left-hand vertical axis represents the number of stepper motor pulses supplied to the stepper motor 17. A right-hand vertical axis represents a number of encoder pulses which correspond to movement of the motor 21.

A line 50 represents the relationship between the movement printhead carriage 13 and number of stepper motor pulses supplied to the stepper motor 17. It can be seen that the line 50 is a straight line. As such, each step moved by the stepper motor 13 causes a corresponding movement of the printhead carriage 13. A reference position R represents the printhead carriage 13 being at one end of the linear track 15, with the printhead in contact with the printing surface 11.

Given the coupling between the printhead carriage 13 and the printhead assembly 4, via the pivot 14 (which is described in detail above), it will be understood that any lateral movement of the printhead carriage 13 in the direction A (FIG. 1) will also cause a corresponding movement of the printhead assembly 4 in the direction B (FIG. 1)—that is unless the printhead rotation belt 23 is also caused to move. As such, to maintain the position of the printhead assembly in the direction B, any movement of the motor 17 (and thus movement of the printhead drive belt 19), should be matched by an equivalent movement of the motor 21 (and thus movement of the printhead rotation belt 23). The line 50 thus also represents the number of pulses from encoder 37 which must be moved by the motor 21 so as to maintain the relative position of the printhead assembly 4 in the direction B as the printhead carriage 13 is moved in the direction A. For any printhead carriage position relative to the reference position R, there is a number of steps which will have been moved by the motor 17, and a corresponding number of encoder pulse which will have been moved by the motor 21. Thus, for an arbitrary printhead carriage position D relative to the reference position R, the motor 17 will have moved a number of steps D', and the motor 21 will have moved an amount which has caused a number of encoder pulses D" to be generated.

Similarly, any movement of the printhead drive belt 19 with respect to the printhead rotation belt 23 will result in a change in the position of the printhead assembly in the direction B. A second line 51 is offset from and parallel to the first line 50. The offset between the line 51 and the line 50 represents an offset between the amount of movement of the printhead drive belt 19 and the printhead rotation belt 23, and thus a displacement of the printhead assembly 4 in the direction B. The line 51 thus represents the number of encoder pulses required to be moved by the motor 21 to cause the printhead assembly 4 to be maintained in the ready to print position (which is slightly offset from the contact position) as the printhead carriage 13 is moved in the direction A.

A third line 52 is offset from and parallel to the first line 50 in the opposite direction from the line 51. The offset between the line 52 and the line 50 represents an offset between the amount of movement of the printhead drive belt 19 and the printhead rotation belt 23, and thus a displacement of the printhead assembly 4 in the direction B. The line 52 represents the number of encoder pulses which could be required to be moved by the motor 21 to cause the printhead assembly 4 to be maintained in a position which is beyond the contact position with the printing surface 11. However, it will be appreciated that this position cannot be achieved, due to the printing surface 11 obstructing the movement of the printhead assembly 4. The line 52 therefore can be understood to represent a target position which, when supplied to the position controller 31 will cause the printhead to be pressed against the printing surface 11. The torque limit TL described above will result in the printhead being pressed against the printing surface 11 with the predetermined force.

The relationships described above with reference to FIG. 8 may take the form of a look-up table which is accessible by the controller 31 and which allows positional control of the motor 21 based upon both the position of the printhead carriage 13 in direction A, and a target position of the printhead assembly 4 in the direction B. That is, for each position of the printhead carriage 13 (i.e. for each position on the x-axis of FIG. 8), a target position for the motor 21 in terms of a number of encoder pulses can be derived from FIG. 8 for three different target positions of the printhead with respect to the printing surface 11. A first target position corresponds to the ready-to-print position and is represented by the line 51. A second target position corresponds to the point at which contact is made between the printhead and the printing surface 11, and is represented by the line 50. A third target position corresponds to a point beyond the contact position with the printing surface 11, and is represented by the line 52. The third target position allows the printhead to be pressed against the printing surface 11 with the predetermined force printing as described above.

Further target positions may be provided as necessary. For example, an additional line which corresponds to the home (retracted) position may be provided.

Once the required movement speed of the printhead carriage 13 has been established, (including a corresponding movement of the printhead rotation belt 23 and motor 21), processing passes to step S15, where printing is carried out. The printhead is energised as it passes along the printing surface 11, transferring ink to the substrate 10 as required.

As described above with reference to FIG. 4, where continuous printing is required to be carried out (as opposed to intermittent printing), step S14 can be omitted, and processing can pass directly from step S13 to step S15.

Once printing is complete, processing passes step S16, where the target position specified to the position controller 31 is commanded to move to the ready-to-print position (i.e. line 51). This causes the motor 21 to be energised in the reverse direction (i.e. anti-clockwise), causing the printhead assembly 4 to be moved away from the printing surface 11.

Once the printhead assembly is retracted to the ready-to-print position, processing passes to step S17, where the printhead carriage 13 is moved, by appropriate control of the motor 17 to be ready for a subsequent printing operation. The printhead carriage 13 may be moved along the linear track 15 in the opposite direction to the direction of movement during a printing operation. A corresponding adjustment to the target position specified to the position controller 31 is also made, according to the lines 50 and 51. As such, as the printhead carriage 13 moves along the linear track 15, the printhead remains in the ready to print position.

Of course, where continuous printing is carried out, step S17 may be omitted (as with step S14). Processing then passes to step S18, where it is determined whether more printing is required. If yes, processing returns to step S12, where a next 'print' command is awaited. On the other hand, if no more printing is required, processing terminates at step S19.

It will be appreciated that while it is described above the motor 21 is controlled in a combined torque and position controlled mode, other control techniques are possible. That is, the motor 21 can be controlled in different operating modes, such as, for example, a first operating mode which may be referred to as a torque-controlled mode. In the first operating mode, torque may be the dominant control parameter. The second operating mode may be referred to as a position-controlled mode. In the second operating mode, position may be the dominant control parameter.

In more detail, the motor 21 can be controlled in a position controlled manner (for example, using positional feedback provided by the encoder 37, or an open loop positional control mode) when not in contact with the printing surface, and when held in the ready-to-print position. However, when printing is required, the torque output of the motor 21 can be controlled in a torque controlled manner. That is, when the printhead is in the ready-to-print position, under positional control, and a print signal is received the motor 21 can be controlled to cause the printhead to move towards the printing surface, as described above with reference to step S13. However, prior to, or at the point of, contact between the printhead and the printing surface 11, the motor 21 can be switched to a torque control mode. Such a transition may be carried out immediately upon receipt of the print command. This would result in the printhead being driven towards and making contact with the printing surface 11 whilst the motor 21 was in a torque controlled mode.

Alternatively the transition between position and torque control may be based upon reaching a known position. For example, the transition may be carried out based upon a known number of encoder pulses which correspond to the contact position (as determined during initialisation), or an increased motor torque (as detected by resistors 44*a*, 44*b*, 44*c*—FIG. 6).

A target torque is set to generate a predetermined printing force. This results in the printhead being driven towards the printing surface 11 and the predetermined printing force being developed.

Printing then occurs, as described above, with the printhead carriage 13 moving as required to move the printhead along the printing surface 11 in intermittent mode printing. During this movement, the motor 21 remains under torque control and will move as required to maintain the predetermined torque level (and thus contact force)

Once printing is complete, the motor 21 is again controlled in a position controlled manner to withdraw to the ready to print position (or to a fully retracted position) as required. For example, such movement can be carried out by moving the motor 21 through a number of encoder pulses which correspond to the required amount of movement.

Similarly, the motor 21 can be controlled in a position controlled manner to maintain the printhead in the ready to print positon as the printhead carriage 13 is moved after the end of printing operations. In particular, the printhead carriage 13 may be moved along the linear track 15 in the opposite direction to the direction of movement during a printing operation by operation of the motor 13. During this movement, the motor 21 may be controlled in an open loop manner, with an excitation field applied to the windings of the motor 21 being rotated by an amount which corresponds to the movement of the motor 13 required to move the printhead carriage 13 along the track 15 (such a relationship being illustrated by line 51 in FIG. 8).

Such a control arrangement provides the benefit of torque control during printing while also providing the benefit of positional control between printing cycles.

The pressure to be applied by the printhead may, for example, be 15.7 N (1.6 kgf) for a 53 mm printhead width. Such a pressure can be converted to a torque to be output by the motor 21. Such a conversion will depend upon the mechanical coupling (including the relative lengths of arms 25, 26 and the diameter of the pulley 22), and any gearing effect of the said coupling. The required torque can then be converted to a current limit according to the torque constant of the motor 21, that is, the Newton-metres (Nm) of torque generated per unit Ampere (A) of current (Nm/A).

Further, the pressure to be applied by the printhead may be varied in dependence upon the substrate speed. The pressure to be applied by the printhead may also be specified by a user as a percentage of a pressure to be applied given a particular substrate speed. A pressure of 50% may be considered to be nominal.

The printer may store data indicating a minimum pressure (associated with user input of 0%) and a maximum pressure (associated with user input of 100%) when particular user input is received the pressure to be applied may be determined by linear interpolation from the stored minimum pressure and stored maximum pressure.

In above described embodiments the motor 21 is a DC motor. However, in alternative embodiments different motors may be used to drive the printhead rotation belt 23 and, therefore, to control the printhead pressure. For example, in an embodiment the motor is a stepper motor. The stepper motor may be associated with a rotary encoder which provides information relating to the rotary position of the motor shaft. Such information enables the windings of the stepper motor to be driven in a closed-loop manner.

In such an arrangement drive electronics which control commutation of the windings of the stepper motor receive, as inputs, a desired angular position and an actual angular position (from the encoder). The drive electronics then generate electrical signals which are provided to the windings of the stepper motor so as to cause the stator field to rotate to a position which will cause the rotor to move in the desired way.

In this way, the torque generated by the motor can be controlled and optimised. For example, by controlling the torque angle (that is, the angular offset between the stator field position and the rotor position) the torque can be maximised for a particular magnitude of current supplied to the motor windings. In particular, it is known that a stepper motor produces maximum torque when a torque angle of 90 (electrical) degrees is used. Thus, the use of such a torque angle allows the stepper motor to generate a maximum torque for a given winding current.

Moreover, the use of positional feedback based upon the output of an encoder allows the motor winding currents to be modulated so as to produce a desired torque level. That is, rather than controlling the stepper motor to operate in an open-loop position controlled mode, the stepper motor can be operated in a closed-loop manner, using positional feedback. With such a control arrangement, and by appropriate control of the current supplied to the windings of the stepper motor, the torque generated by the stepper motor, and hence the printhead pressure can be controlled to a predetermined value.

Of course, it will be appreciated that the use of a stepper motor also allows the use of conventional open-loop stepper motor control when beneficial. For example, such open-loop control may be used to move the printhead in free-space, or to maintain a predetermined free-space position of the printhead (e.g. when the printhead is maintained in the ready to print position prior to commencing a printing operation, or during printhead carriage movement between printing cycles). However, by providing accurate information relating to the angular position of the rotor, it is possible to achieve many of the benefits conventionally associated with stepper motors (e.g. high torque output, low-cost, and high-speed operation) while also providing advantageous characteristics usually associated with DC motors (e.g. a well-known relationship between the current supplied to the motor and the torque output by the motor). Moreover, by providing accurate positional information, and controlling the stator field based upon this information, there is no risk that a stepper motor will stall if the load is greater than the maximum torque capacity.

Figure 4:
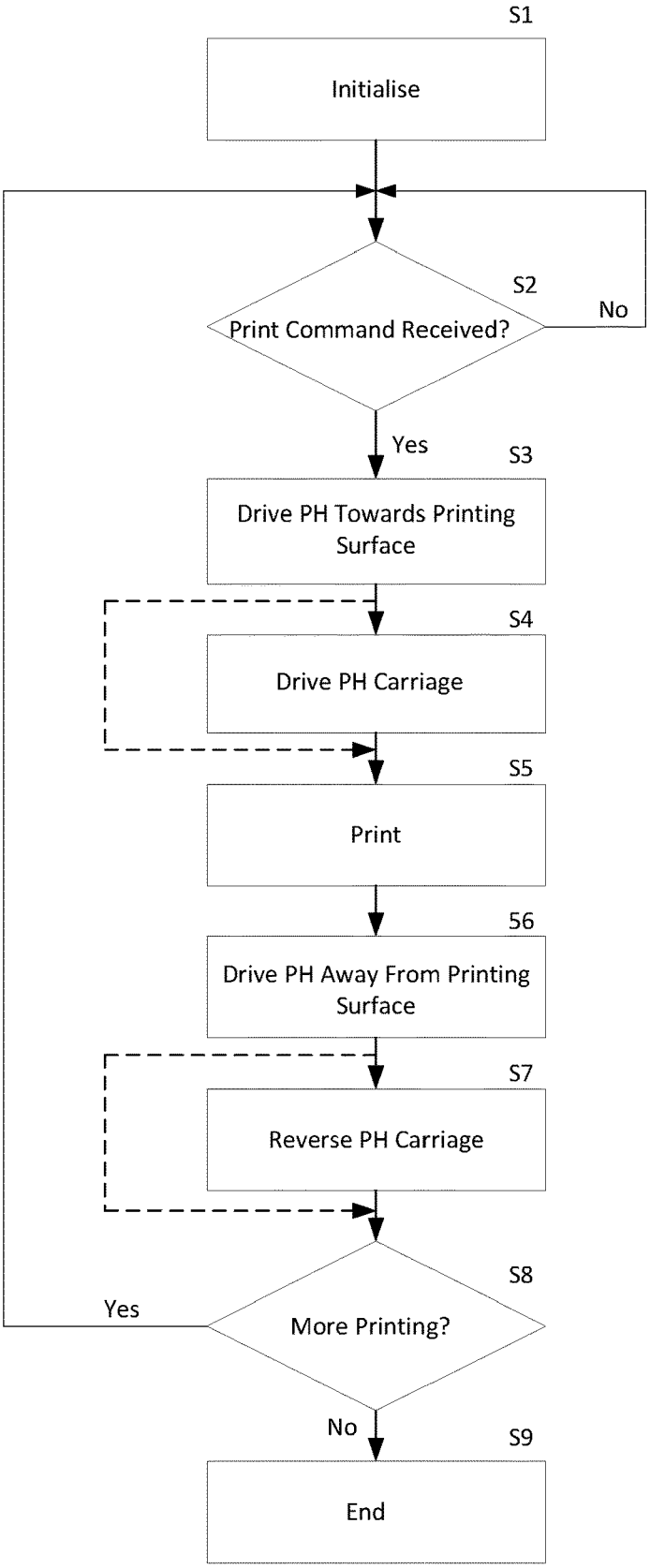
FIG. 4 is a flowchart showing control of the position of the printhead relative to a printing surface during printing operations.
Figure 7:
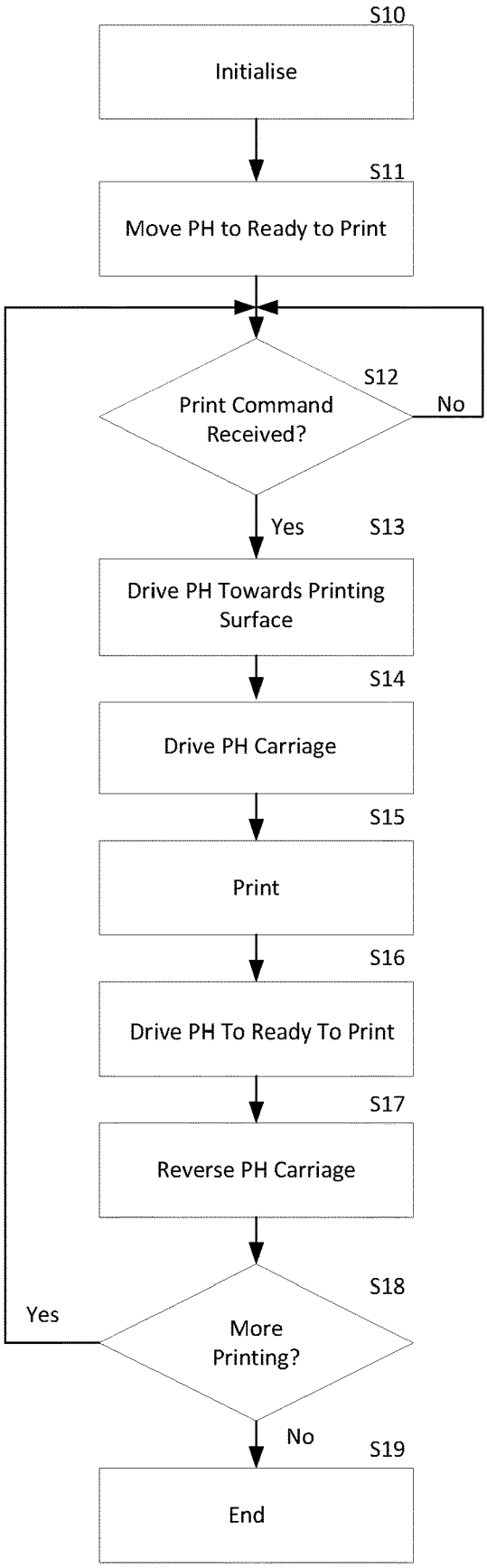
FIG. 7 is a flowchart showing control of the position of the printhead relative to a printing surface during printing operations.

Thus, a stepper motor may be used in place of a DC motor with control carried out as described further above, for example, with reference to FIGS. 4 and 7. In this way, by controlling the current supplied to windings of the stepper motor based upon information relating to the angular position of the rotor, the phase angle of the field generated by the motor is controlled. This type of control allows the stepper motor to be operated in a torque-controlled manner, so as to generate a predetermined output torque. Such a generated torque can be converted (via a suitable mechanical coupling) to a predetermined force (corresponding for a particular area to a predetermined pressure) which is to be exerted by the printhead on the printing surface during printing operations.

In parts of the foregoing description, references to force and pressure have been used interchangeable. Where the surface against which the printhead presses has constant area it will be appreciated that force and pressure are directly proportional, such that pressure may in practice be defined in terms of the force applied. However, the pressure applied will depend upon the width of the printing surface 11 (i.e. the dimension extending into the plane of the paper in FIG. 2) against which the print head 13 applies pressure. The pressure—for a given torque generated by the motor 21—is greater the narrower the printing surface 11, and so is the extent of compression of the printing surface, and vice versa. The printer may provide for several mounting positions for the printhead and the ability to vary the width of the printhead or printing surface. As such, the controller 30 may additionally process information indicating the width of the printing surface 11 against which the printhead presses and use this width information to determine the required torque to be generated by the motor 21.

Various controllers have been described in the foregoing description (particularly with reference to FIGS. 1, 5 and 6). It will be appreciated that functions attributed to those controllers can be carried out by a single controller or by separate controllers. It will further be appreciated that each described controller can itself be provided by a single controller device or by a plurality of controller devices. Each controller device can take any suitable form, including ASICs, FPGAs, or microcontrollers which read and execute instructions stored in a memory to which the controller is connected.

While embodiments of the invention described above generally relate to thermal transfer printing, it will be appreciated that in some embodiments the techniques described herein can be applied to other forms of printing, such as, for example, direct thermal printing. In such embodiments no ink carrying ribbon is required and a printhead is energised when in direct contact with a thermally sensitive substrate (e.g. a thermally sensitised paper) so as to create a mark on the substrate.

While various embodiments of the invention have been described above, it will be appreciated that modifications can be made to those embodiments without departing from the spirit and scope of the present invention. In particular, where reference has been made above to printing onto a label web, it will be appreciated that the techniques described above can be applied to printing on any substrate.

The invention claimed is:

1. A printer comprising:

a printhead configured to selectively cause a mark to be created on a substrate;

a first motor coupled to the printhead and arranged to vary the position of the printhead relative to a printing surface against which printing is carried out to thereby control the pressure exerted by the printhead on the printing surface; and a controller arranged to control the first motor in first and second operating modes; wherein:

in the first operating mode, the controller is arranged to control the magnitude of current supplied to windings of the first motor so as to cause a predetermined pressure to be exerted by the printhead on the printing surface wherein the magnitude of current supplied to the first motor generates a known torque output of the motor and a known pressure exerted by the print head on the printing surface; and, in the second operating mode, the controller is arranged to control the angular position of an output shaft of the first motor so as to control the position of the printhead relative to the printing surface.

2. A printer according to claim 1, wherein in the second operating mode the printhead is spaced apart from the printing surface.

3. A printer according to claim 1, wherein the controller is arranged to control the first motor based upon a sensor signal indicating angular displacement of an output shaft of the first motor.

4. A printer according to claim 3 wherein, in the first operating mode, the first motor is controlled based upon the sensor signal indicating angular displacement of the output shaft of the first motor.

5. A printer according to claim 1 wherein, in the first operation mode, the controller is arranged to control current supplied to the windings of the first motor so as to control an orientation of a stator field of said first motor based upon a sensor signal indicating angular displacement of the output shaft of the first motor.

6. A printer according to claim 1, wherein said controller is configured to control the first motor so as to cause the output shaft of the first motor to attempt to rotate by a predetermined angular displacement.

7. A printer according to claim 6, wherein the controller is arranged to control the first motor so as to command the output shaft of the first motor to rotate until a signal indicative of actual movement of the output shaft of the first motor indicates that the predetermined angular displacement has been completed.

8. A printer according to claim 1, wherein said controller is configured to control the first motor based upon the target position and a received current position.

9. A printer according to claim 1, wherein said controller is configured to control the first motor in the second operating mode to cause the printhead to maintain a position in which it is spaced apart from the printing surface by a predetermined separation.

10. A printer according to claim 1, wherein said controller is configured to control the first motor in the first operating mode to cause the printhead to move from a position in which it is spaced apart from the printing surface towards the printing surface.

11. A printer according to claim 1, wherein said controller is configured to control the first motor so as to cause the printhead to move from a position in which it is pressed against the printing surface to a position spaced apart from the printing surface in the second operating mode.

12. A printer according to claim 1, wherein controlling the magnitude of current supplied to windings of the first motor comprises providing a pulse width modulated signal to said windings.

13. A printer according to claim 12, wherein controlling the magnitude of current comprises controlling a duty cycle of the pulse width modulated signal provided to said windings.

14. A printer according to claim 1, wherein controlling the magnitude of current supplied to windings of the first motor comprises controlling an average current supplied to said windings.

15. A printer according to claim 1, wherein the printhead is rotatable about a pivot and wherein the first motor is arranged to cause rotation of the printhead about the pivot to vary the position of the printhead relative to the printing surface.

16. A printer according to claim 15, further comprising a printhead assembly, the printhead assembly comprising a first arm and a second arm, the first arm being coupled to the first motor, and the printhead being disposed on the second arm, wherein the first motor is arranged to cause movement of the first arm, thereby causing rotation of the second arm about the pivot, and causing the position of the printhead relative to the printing surface to vary.

17. A printer according to claim 16, wherein the first motor is coupled to the first arm via a flexible linkage, and the linkage is a printhead rotation belt, and the printhead rotation belt passes around a roller driven by the output shaft of the first motor such that rotation of the output shaft of the first motor causes movement of the printhead rotation belt, movement of the printhead rotation belt causing the rotation of the printhead about the pivot.

18. A printer according to claim 1, further comprising a printhead drive mechanism for transporting the printhead along a track extending generally parallel to the printing surface.

19. A printer according to claim 18, wherein the controller is configured to control the first motor in the second operating mode to cause the printhead to maintain a position in which it is spaced apart from the printing surface by a predetermined separation during transport of the printhead along the track extending generally parallel to the printing surface.

20. A printer according to claim 18, wherein the controller is configured to control the first motor in the first operating mode to cause said predetermined pressure to be exerted by the printhead on the printing surface during transport of the printhead along the track extending generally parallel to the printing surface.

* * * * *